US005587775A

United States Patent [19]

Taniguchi et al.

[11] Patent Number: 5,587,775

[45] Date of Patent: Dec. 24, 1996

[54] IMAGE FORMING APPARATUS WITH ROTATING BRUSH FOR CHARGING

[75] Inventors: Kazuko Taniguchi, Takatsuki; Akihito Ikegawa, Sakai; Koji Uno, Toyokawa; Hitoshi Saito, Mie-ken, all of Japan

[73] Assignee: Minolta Co., Ltd., Osaka, Japan

[21] Appl. No.: 555,780

[22] Filed: Nov. 9, 1995

[30] Foreign Application Priority Data

Nov. 10, 1994 [JP] Japan ..... 6-276500

[51] Int. Cl.[6] ..... G03G 15/02

[52] U.S. Cl. ..... 355/219; 355/269; 361/221; 361/225

[58] Field of Search ..... 355/219, 269, 355/301; 361/221, 222, 225, 214

[56] References Cited

U.S. PATENT DOCUMENTS

| | | | |
|---|---|---|---|
| 5,126,913 | 6/1992 | Araya et al. | 361/225 |
| 5,148,219 | 9/1992 | Kohyama | 355/219 |
| 5,359,395 | 10/1994 | Shimura et al. | 355/219 |
| 5,371,578 | 12/1994 | Asano et al. | 355/219 |
| 5,426,488 | 6/1995 | Hayakawa et al. | 355/219 |

FOREIGN PATENT DOCUMENTS

| | | |
|---|---|---|
| 5-119579 | 3/1993 | Japan . |
| 5-127492 | 11/1993 | Japan . |

*Primary Examiner*—Arthur T. Grimley
*Assistant Examiner*—Sophia S. Chen
*Attorney, Agent, or Firm*—Brinks Hofer Gilson & Lione

[57] ABSTRACT

An image forming apparatus for forming a latent image by image exposure on an image bearing member which is charged by a charge brush of a charging device, and developing the latent image by a developing device, transferring the developed image on a sheet, and cleaning the residual toner on the image bearing member by the developing device. The rotational brush rotates in such a direction that a contacting portion of the brush with the image bearing member moves in the same direction as a moving direction of a surface of the image bearing member, and is provided to satisfy the following condition:

$$20 \leqq (N)^2/t \leqq 35,$$

wherein N is a contact nip width between the charging brush and the image bearing member and t is a thickness of the charging brush.

4 Claims, 10 Drawing Sheets

IMAGE FORMING APPARATUS WITH ROTATING BRUSH FOR CHARGING

BACKGROUND OF THE INVENTION

1. Field of the Invention

The present invention relates to an image forming apparatus such as a copier, printer and the like using electrophotographic methods.

2. Description of the Related Art

In image forming apparatus such as copiers, printers and the like using electrophotographic methods, typically the surface of a photosensitive drum is charged via a charger, and exposed to an optical image in said charged region so as to form an electrostatic latent image thereon which is then developed so as to be rendered visible, and transferred onto a transfer member upon which the developed image is fixed.

In recent years, various apparatus have been proposed which omit a cleaning device in accordance with demand for more inexpensive and more compact apparatus.

For example, U.S. Pat. No. 5,148,210 discloses a so-called cleanerless image forming apparatus which combines a cleaning device with a developing device.

Various types of charging devices are known, but such devices can be broadly divided into corona chargers which use a corona discharge, and contact chargers wherein a charging member makes contact with a latent image-bearing member. Contact chargers use a stationary brush, rotating brush, charging roller-type member, or rotatably driven belt-like charging member.

Charging devices using a corona discharge are advantageous in that provide stable charges, but are disadvantageous insofar as they generate large amounts of ozone which causes deterioration of the photosensitive member typically used as an image-bearing member, and which is extremely toxic to humans. Thus, contact chargers which produce markedly less ozone than corona charger are preferable.

Among contact chargers are brush-type chargers which, when used in the previously mentioned cleanerless type image forming apparatus, provide a brush in said charger that disrupts the residual developer remaining on the surface of the latent image-bearing member after image transfer, e.g., disruption via a rotating brush, and suppress inadequate charging of residual developer and inadequate optical exposure during subsequent image forming processes, and thereby suppress so-called memory generation (refer to U.S. Pat. No. 5,148,219).

In general, rotating brushes provide better charge stability than stationary brushes.

On the other hand, in the case of image forming apparatus having a cleanerless type construction wherein a cleaning device is combined with a developing device and which use a rotating charging brush as a charger, the residual developer remaining after image transfer cannot be adequately dispersed by just using a rotating brush in the charger. In general, when a rotating brush is used in a charger, residual developer remaining after image transfer is effectively dispersed when the transfer efficiency is about 85% or greater, but when the transfer efficiency is lower, the dispersion effectiveness is reduced.

When the transfer efficiency is 60%, for example, dispersion effectiveness is reduced and poor image quality readily results. When the residual developer is not adequately dispersed in the charging area, an unexposable region is generated on the surface of the latent image-bearing member which is to be originally exposed in the image exposure process, thereby preventing the satisfactory image formation.

In order to improve dispersion effectiveness, it was considered to rotate the rotating brush in a direction counter to the direction of movement of the surface of the latent image-bearing member, i.e., the rotating brush is rotated in a direction opposite to the direction of movement of said latent image-bearing surface, but in practice such an arrangement caused the developer to be strongly pressed against the surface of the latent image-bearing member so as to scratch said surface. Thus, the dispersion effectiveness of the developer after image transfer was lost, and so-called developer filming results which prevents image formation when such filming becomes pronounced.

SUMMARY OF THE INVENTION

A main object of the present invention is to provide a cleanerless image forming apparatus capable of normally forming excellent images.

Another object of the present invention is to provide a cleanerless image forming apparatus using a rotating brush as a charger, and which eliminates the concern of developer filming even when transfer efficiency is low.

Still another object of the present invention is to provide a cleanerless image forming apparatus using a rotating brush as a charger, and which is capable of producing adequate disruption action when disturbing the residual developer remaining after image transfer.

These and other objects of the present invention is accomplished by an image forming apparatus comprising an image bearing member, a charging device including a rotatable brush for charging the image bearing member to form a latent image on the image bearing member by image exposure, developing device for developing the latent image and collecting residual toner remaining on the image bearing member after transferring the developed image, wherein said rotatable brush rotates in such a direction that a contacting portion of the brush with the image bearing member moves in the same direction as a moving direction of a surface of the image bearing member, and is provided to satisfy the condition of $20 \leqq (N)^2/t \leqq 35$, wherein N is a contact nip width between the charging brush and the image bearing member and t is a thickness of the charging brush.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 5 is shows examples of the construction of a brush member which forms the rotating brush of the charging device;

FIG. 6A is a brief section view of the brush member; and

FIG. 6B is a brief plan view of said brush member;

FIG. 7 shows examples of W-type woven piles on a fabric base in forming the brush member of FIG. 5A;

DESCRIPTION OF THE PREFERRED EMBODIMENTS

The inventors, during in-depth studies to resolve the previously mentioned problems, have discovered that developer filming can be suppressed if the rotational direction of the rotating brush is set in a direction such that the contact region of said brush and the latent image-bearing member follows the movement of the surface of the latent image-bearing member. The inventors have further discovered that dispersion of the developer after image transfer and disruption effectiveness can be adequately achieved if the direction of the rotating brush is set in the aforesaid following direction, and the contact nip N between the brush and the latent image-bearing member and the brush thickness t satisfy specific conditions.

Further explanations of each element of this image forming apparats are shown below.

(1) Rotating brush in a charging device

*Various constructions of the rotating brush were considered, and a representative example is formed by mounting the brush member on a rotatably driven core rod.

In this case, although various construction of the brush member itself are considered, a representative example has a so-called velveteen (velvet) weave construction from the perspectives of desirable strength, mass production characteristics, fiber density and the like. That is, as shown in FIG. 5A, pile P comprising the brush fibers are woven at equal spacing on base B1 as a base member to form BM1.

Figure 5A:
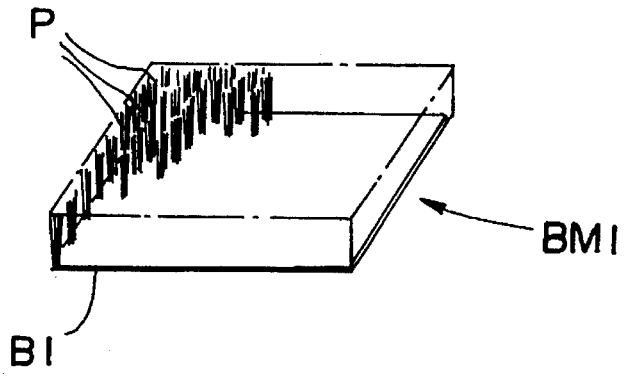
FIG. 5A shows a pile woven on a fabric base.
Figure 5B:
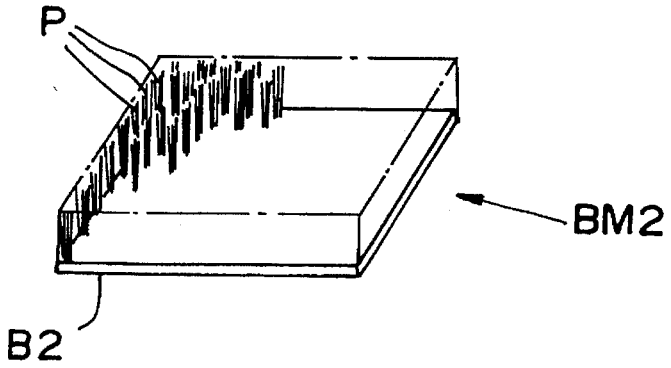
FIG. 5B shows a pile woven on a synthetic resin base member.
Figure 5C:
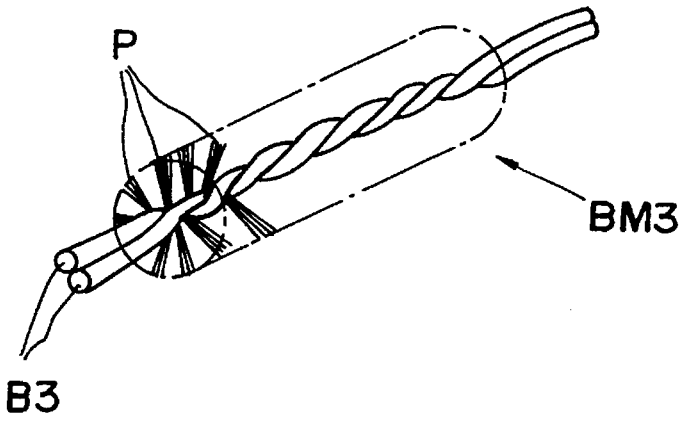
FIG. 5C shows a pile woven on a twisted fiber material or a rod material.

Alternatively, as shown in FIG. 5B, pile P comprising the brush fibers may be implanted at equal spacing in sheet-like flexible synthetic resin base member B2 to form BM2. Also considered, as shown in FIG. 5C, is a rotating brush pile P comprising the brush fibers are implanted at equal spacing in a base member comprising two twisted wires or rods to form BM3.

Figure 6:
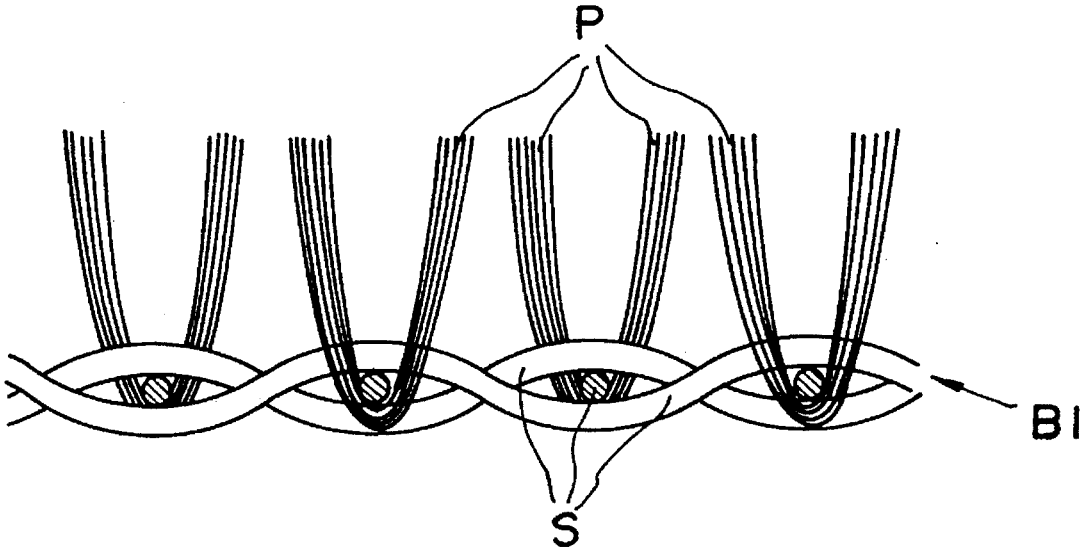
FIG. 6 shows examples of V-type woven piles on a fabric base in forming the brush member of FIG. 5A.
Figure 6:
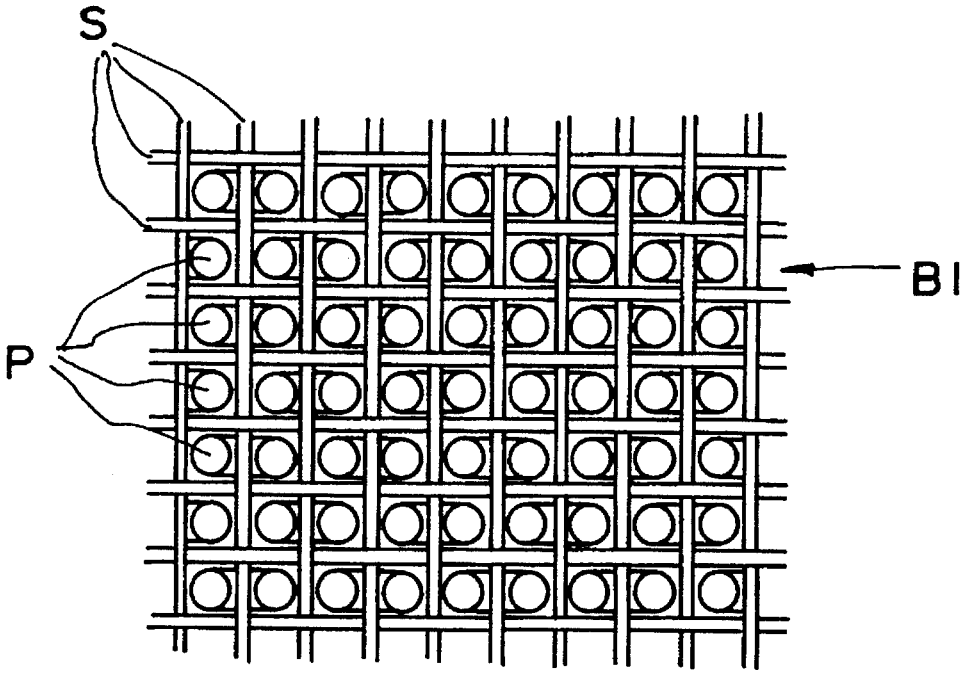
Figure 7A:
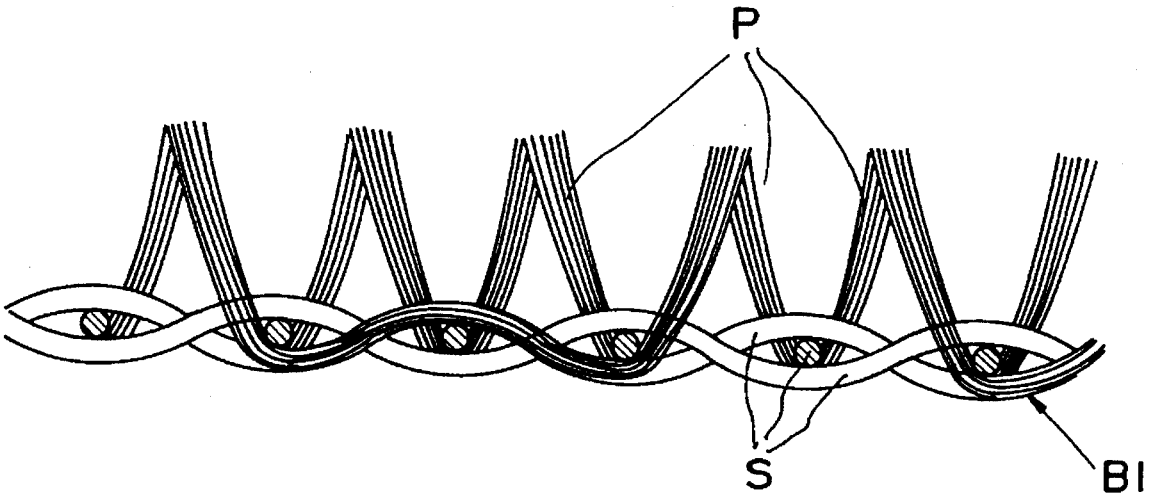
FIG. 7A is a brief section view of the brush member.
Figure 7B:
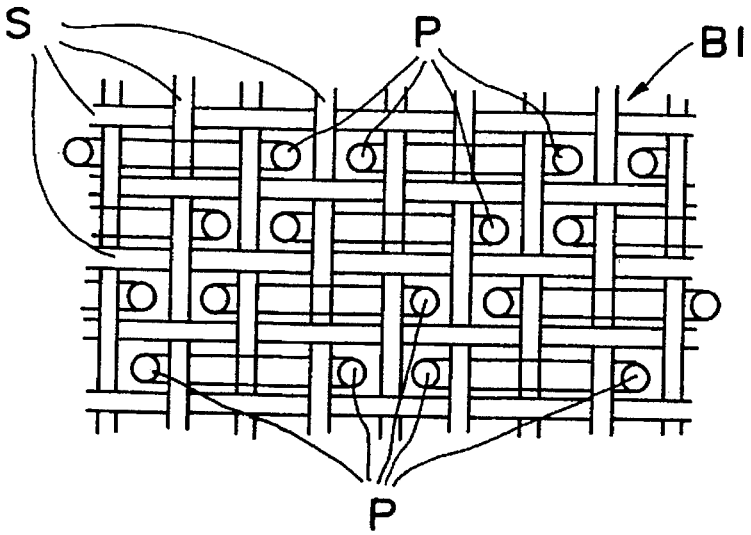
FIG. 7B is a brief plan view of said brush member.

When brush BM1 shown in FIG. 5A is used, a representative example of the weave direction of the pile P in fabric base B1 may be a V-type weave wherein fibers S of pile P are woven in a V-shape weave to fabric base B1, as shown in FIGS. 6A and 6B; and may be a W-type weave wherein fibers S of pile P are woven in a W-shape weave in fabric base B1, as shown in FIGS. 7A and 7B. The W-type weave makes it more difficult for fibers to fall out than the V-type weave.

Specific weaving methods have been considered, including inserting the pile P in fabric base B1, and comb tieing said pile on the back side of the fabric base.

Modified examples (examples with different pile pitch) of the V-type weave and W-type weave are shown in FIGS. 6 and 7, and weaving methods are considered in FIGS. 8B~8F.

Figure 8:
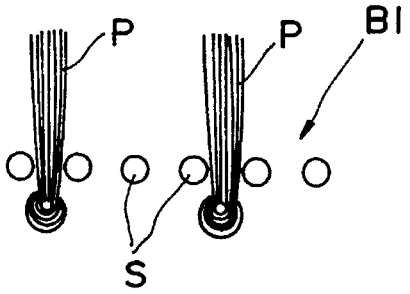
FIGS. 8A, 8B, 8C, 8D, BE, and 8F are other examples of weaving the piles on a base to form the brush member of FIG. 5A.
Figure 8:
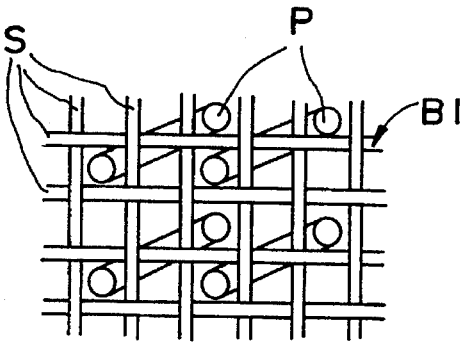
Figure 8:
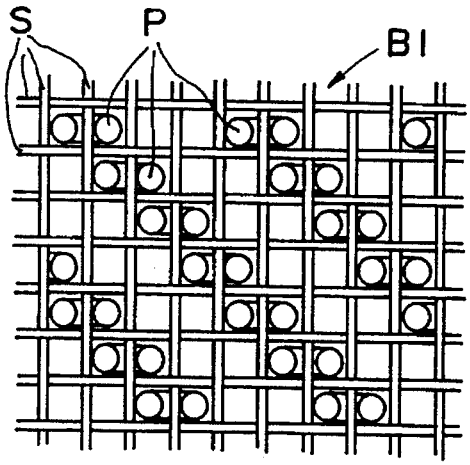
Figure 8:
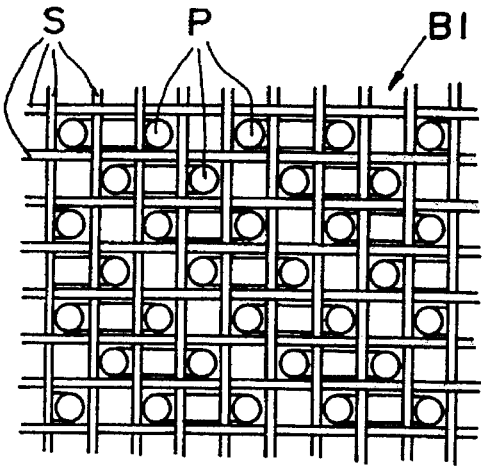
Figure 8:
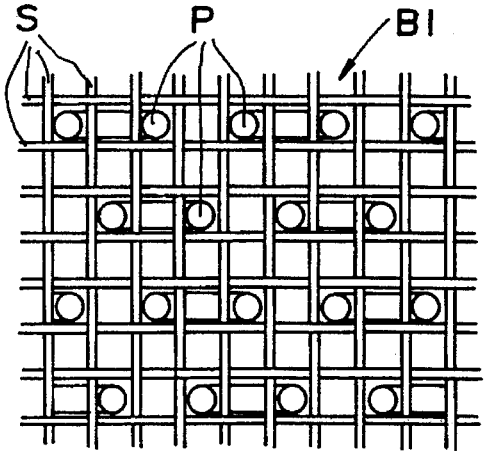
Figure 8:
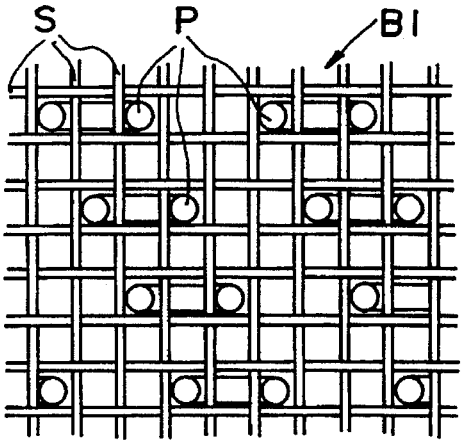

The example of FIG. 8B is a weaving method wherein fabric base threads S and pile P lack a horizontal relationship; mass production characteristics are poor, but when an application process is performed on the back side of the fabric base, a uniform application is easy because it becomes difficult for the application fluid to run along the thread. The example of FIG. 8C has a thinned pile P in the V-type weave shown in FIG. 6. The example of FIG. 8D has increased threads in fabric base S hooking pile P when the V-type weave and weaving method of FIG. 8C is used. The example of FIG. 8E has thinned pile P in the vertical direction relative to FIG. 8D. The example of FIG. 8F has different thread spacing of the V-type weave and threads hooking pile P relative to FIG. 8D.

Other useable examples may modify pile pitch by various methods, mix different weaves, change thread diameter of the fabric base, mix piles of different diameters and the like,

*Brush fiber materials should be considered in light of the chargeability of the latent image-bearing member such as a photosensitive member, surface hardness, exterior diameter, positional relationship of the rotating brush with other elements, and apparatus system speed, and the material is not specifically limited insofar as the selected material has suitable electrical resistivity, flexibility, hardness, configuration, and strength so as to obtain a desired charge when a DC voltage is applied or AC voltage is overlaid on a DC voltage as a charging voltage.

Examples of materials useful as conductive metal brush fibers include metal fibers such as tungsten, stainless steel, gold, platinum, aluminum, iron, copper and the like, adjusted to suitable fiber length and fiber diameter.

Examples of conductive resins useful as brush fiber material include fibers comprising rayon, polyamide, cuprammonium, vinylidene, vinylon, ethylene fluoride, benzoate, polyurethane, polyester, polyethylene, polyvinyl chloride, polypropylene and the like in which is dispersed resistance regulating agents such as carbon black, carbon fiber, metal powder, metal whiskers, metal oxides, semiconductive materials and the like. In this case, a suitably desirable resistance value can be obtained by the amount of said dispersed material added to the resin. Furthermore, the resistance regulating material need not be dispersed, and may be used as an overcoating on the fiber surface.

The electrical resistivity of the aforesaid fiber material will typically be such as to obtain a volume resistivity of less than $10^9$ Ωcm, and desirably less than $10^7$ Ωcm so as to achieve desired charging characteristics.

The cross section configuration of the fibers is not specifically limited insofar as charging characteristics are not impaired. Fibers may have a configuration which is circular, rod-like, spiral, polygonal, flat, hollow interior, and like configurations, and easy-to-manufacture configurations may be selected.

*The aforesaid brush member may be such that a base member B3 is rotatably supported by a suitable member, which when rotatably driven causes the pile P to make contact with the surface of a latent image-bearing member, as shown in FIG. 5C. In this case, the base member B3 may be formed of conductive metal conductive synthetic resin, or be formed of an insulated material treated by a surface process so as to possess conductive properties.

Figure 9:
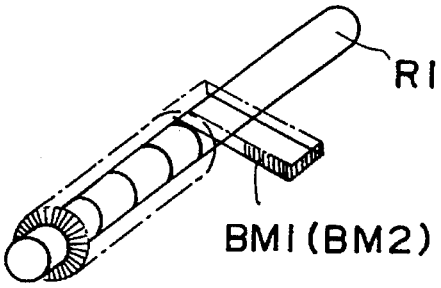
FIGS. 9A, 9B, 9C, 9D, and 9E examples of methods for forming the brush member of the rotating brush shown in FIGS. 5A and 5B.
Figure 9:
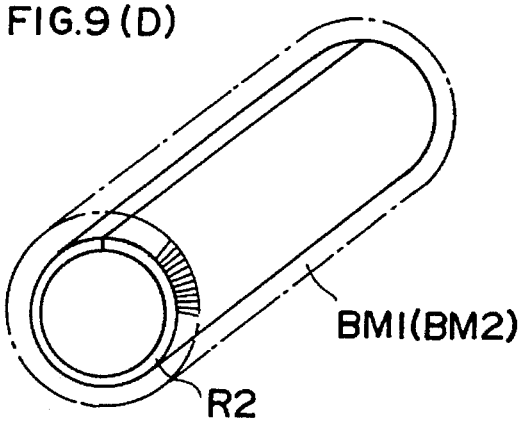
Figure 9:
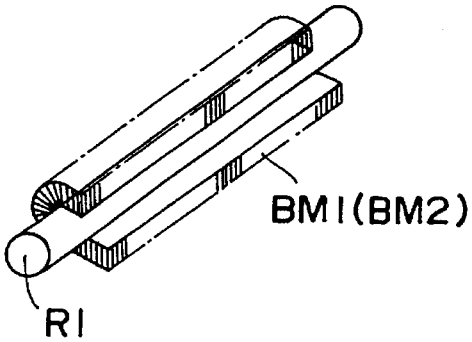
Figure 9:
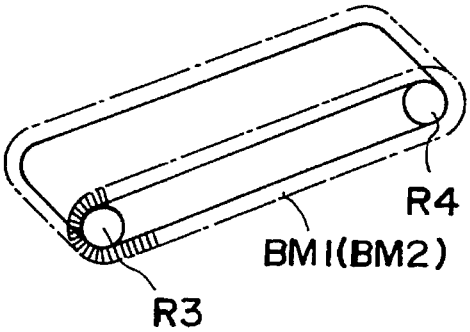
Figure 9:
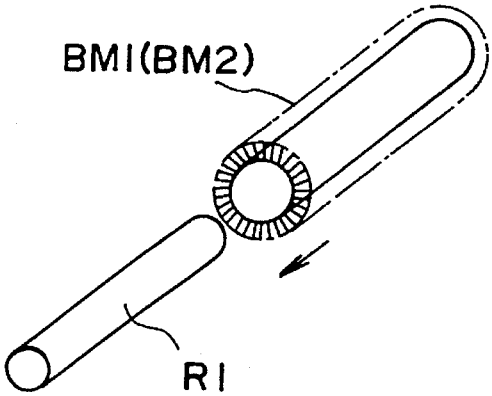

Brush members BM1 and BM2 of the types shown in FIGS. 5A and 5B have been considered wherein, for example, on the surface of a rotatably driven conductive rod R1 formed of conductive metal, conductive resin, or an insulated material treated by a surface process so as to possess conductive properties, is wound a brush member in spiral configuration as shown in FIG. 9A, flat winding as shown in FIG. 9B, preformed cylindrical configuration fixed with conductive adhesive shown in FIG. 9C, or a conductive flat plate member R2 formed of conductive metal, conductive resin, or an insulated material treated by a surface process so as to possess conductive properties is rolled in a cylindrical configuration such that the brush member edge on the surface thereof is inserted between the confronting edges of the flat plate and which is then rotated as shown in FIG. 9D. In this instance also, anchoring may be accomplished by conductive adhesive. As shown in FIG. 9E, in a brush member configured as a preformed endless belt, said brush member is wound around pulleys R3 and R4 at least one of which is rotatably driven, said pulleys being electrically conductive and formed of conductive metal, conductive resin, or an insulated material treated by a surface process so as to possess conductive properties. The rotating brushes thus obtained may contact the surface of photosensitive drum PC, for example, as shown in FIGS. 10A~10C.

Figure 10:
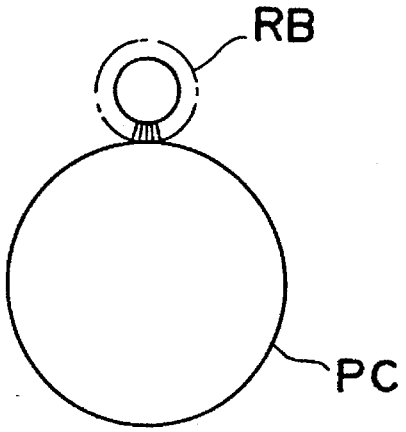
FIGS. 10A, 10B, and 10C show examples of the contact state of the rotating brush relative to the photosensitive member as shown in FIG. 9.
Figure 10:
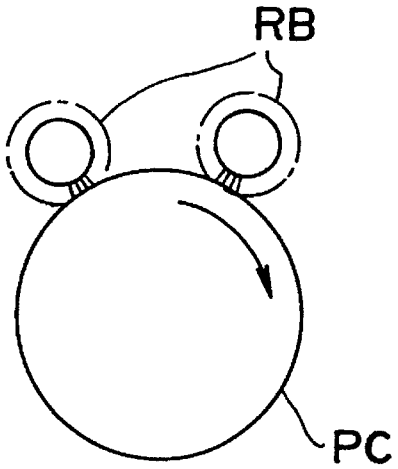
Figure 10:
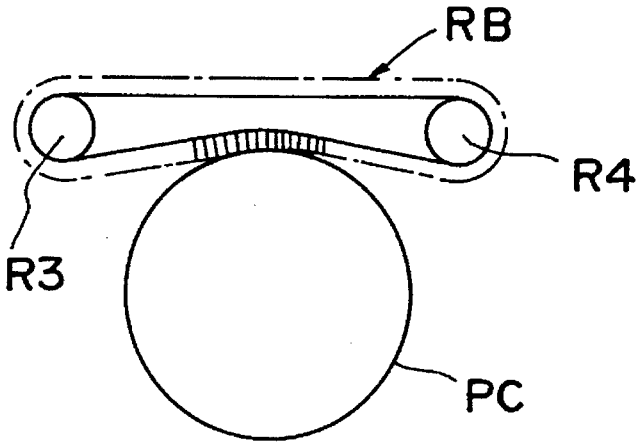

FIG. 10A shows a single roller-type rotating brush RB in a state of contact. FIG. 10B shows two roller-type rotating brushes RB in states of contact. The present invention is adaptable to cases when a plurality of rotating brushes are in states of contact, as a brush on the downstream side in the direction of rotation of the photosensitive drum.

FIG. 10C shows a belt-like rotating brush BB supported on pulleys R3 and R4, wherein the line connecting said pulleys is in the state of contact in a right angle direction relative to the axis of rotation of the photosensitive drum.

Thus, the rotating brush used in the charging device of the image forming apparatus of the present invention may be a roller type brush, or alternatively a belt type brush.

Figure 2:
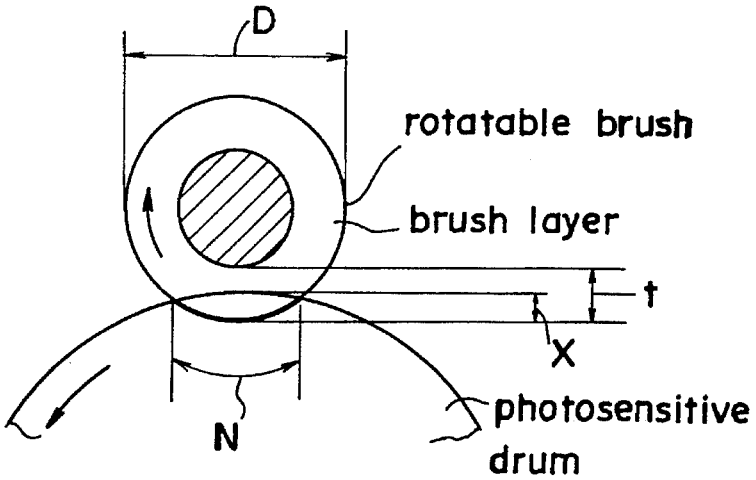
FIG. 2 is an illustration showing the nip width and the amount of overlap of the rotating brush with respect to the photosensitive drum.

(2) Brush thickness t and contact nip N between the rotating brush and latent image-bearing member The latent image-bearing member is a representative photosensitive drum. When the rotating brush is a representative roller type brush such as in the previously described examples, the brush layer of the rotating brush slightly overlaps the photosensitive drum so as to make contact with said drum along the length indicated by the thick solid line in FIG. 2 in a state of covering the photosensitive member. In the drawing, t is the thickness of the brush layer, and X is the amount of overlap of the brush on the photosensitive drum; D is the diameter of the rotating brush, and the arrow indicates the direction of rotation.

(3) Charging voltage supplied to the charger

Figure 11:
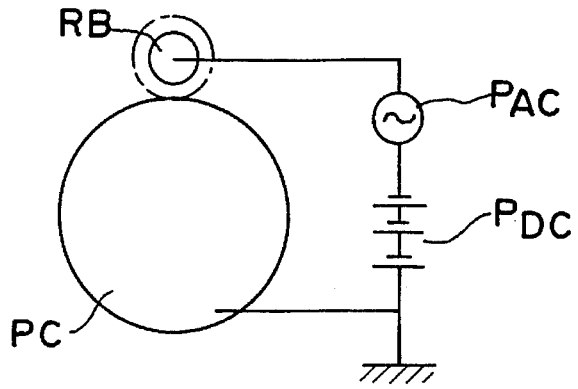
FIG. 11 shows a power source supplying a charging voltage to the rotating brush.
Figure 11:
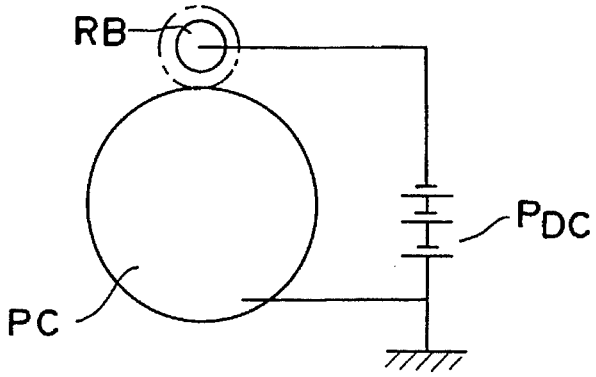
Figure 12:
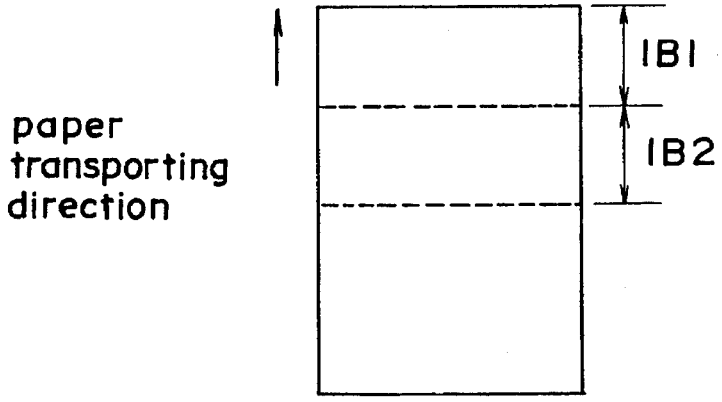
FIG. 12 illustrates the image evaluation method.

In the present invention, consideration has been given to an alternating current (AC) power source $P_{AC}$ and a direct current (DC) power source ($P_{DC}$ are used to supply an overlay of both voltages to the rotating brush as shown in the example of FIG. 11A, and a DC power source $P_{DC}$ alone is used to apply a DC voltage as shown in the example of FIG. 11B. When an AC voltage is overlaid on a DC voltage, the charge potential of the latent image-bearing member is generally more stable than when a DC voltage alone is supplied. In FIG. 11, RB refers to a roller-type rotating brush, and PC refers to a photosensitive drum.

(4) The latent image-bearing member used in the present invention is a representative photosensitive member such as the example described later in the embodiment, i.e., a latent image-bearing member such as a function-separated type organic photosensitive members having excellent sensitivity with respect to long wavelength light such as semiconductor laser light (wavelength: 780 nm) and LED light (wavelength: 680 nm), but the present invention is not limited to said function-separated organic photosensitive member.

Usable photosensitive members will have a photosensitivity with respect to long wavelength light as previously mentioned, in an image forming system using long wavelength light of an optical system such as a semiconductor laser (780 nm), LED array (680 nm) and the like. For example, a usable photosensitive member will have a photosensitivity in the visible range in image forming systems having a light source which emits visible light such as a liquid crystal array, PLZT shutter array and the like, image forming systems having a visible light laser as a light source, image forming systems having a fluorescent emitter array as a light source, or analog image forming systems having a visible light source and an optical system of lenses and mirrors such as that of typical copying machines.

The construction of the photosensitive member may be a function-separated organic photosensitive member having a charge transporting layer superimposed on a charge-generating layer, or alternatively a so-called reverse lamination type photosensitive member having a charge-generating layer superimposed on a charge-transporting layer, or a so-called single layer type photosensitive member having a charge-generating function and charge-transporting function combined in a single layer. The charge-generating material, charge-transporting material, binding resin, additives and the like may be well-known materials suitably selected in accordance with the purpose os its use. The photosensitive materials are not limited to organic photosensitive materials, and usable inorganic materials include zinc oxide, cadmium sulfide, selenium alloy, amorphous silicon alloy, amorphous germanium alloy and the like.

The photosensitive member usable in the present invention may be provided with an overcoat protective layer to improve durability and environmental resistance, and may be provided with an undercoat layer to improve chargeability, image quality, adhesion to a substrate and the like. Examples of useful underlayer materials include ultraviolet curing resins, cold-setting resins, thermosetting resins and the like, mixed resins having resistance regulating materials dispersed n the aforesaid resins, vacuum deposition thin film materials formed by vapor deposition or ion plating of metal oxides or metal sulfides or the like in a vacuum, amorphous carbon film produced by plasma polymerization, amorphous silicon carbide film and the like.

The substrate of the photosensitive member suitable for use in the present invention is not specifically limited insofar as the surface of said photosensitive member substrate is electrically conductive, and its configuration may be cylindrical or belt-like in the case of a rotatable type photosensitive member. The surface of the substrate may be subjected to surface roughening process, oxidation process, coloring process and the like.

(5) Developing device

Developing devices, developers, and developing methods are described in the embodiments which follow, wherein a monocomponent developing device is used which employs a monocomponent developer comprising a toner to accomplish reversal development using a negative-charging, non-transparent, non-magnetic black toner, but the developer and developing method used in the image forming apparatus of the present invention is not limited to the aforesaid.

Usable toners include positive charging toner, optically transparent toner, magnetic toner and the like in accordance with the polarity of the latent image-bearing member and the type of image forming process. Usable colors are not restricted to black toner, and include yellow, magenta, cyan and like color toners suitably selected. The shape of the toner may be undefined, are a specific shape. e.g., spherical toner. Polyvinylidene fluoride lubricant may be added to improve cleaning characteristics.

The developing method used may be suitably selected, e.g., a two-component developing method using a two-component developer comprising a tone rand a carrier, standard developing method and the like.

When a two-component developing method is used, a binder-type indefinite shape carrier may be used which is manufactured in the manner described below.

To 100 parts-by-weight (hereinafter "pbw") polyester resin (tufton NE 1110; Kao K.K.) were added 2 pbw carbon black (MA#8; Mitsubishi Kasei K.K.), and 300 pbw magnetic powder (MFP-2; TDK), and the materials were thoroughly mixed using a Henschel mixer. The obtained mixture was thoroughly kneaded in a dual shaft extruder, cooled, and coarsely pulverized. The coarse material was finely pulverized in a jet mill, and classified by a force-air classification device to obtain fine polymer particles containing magnetic powder and having a mean particle size of 2 μm.

Then, 10 pbw of the aforesaid fine polymer particles containing magnetic powder were added to 100 pbw ferrite carrier (F-250HR; mean particle size: 50 μm; Powdertech, Ltd.), and the mixture was processed for 40 min at 2,500 rpm in an angmill (AM-20F; Hosokawa Micro, Ltd.), to obtain an intermediate carrier having a mean particle size of 55 μm. The intermediate carrier was subjected to heat treatment at 400° C. using a suffusion system (Japan Pneumatic K.K.), to obtain an indefinite-shape binder-type carrier with a target mean particle size of 55 μm.

Carriers which can be used in the image forming apparatus of the present invention is not limited to the aforesaid, and iron powder carrier, resin coated carrier and the like may be suitably selected in accordance with the type of toner used, developing method used, and polarity of the latent image-bearing member. Powder carriers need not be used, inasmuch as developing systems may be selected wherein, for example, a conductive brush, conductive roller or the like performs the function of a carrier.

Figure 1:
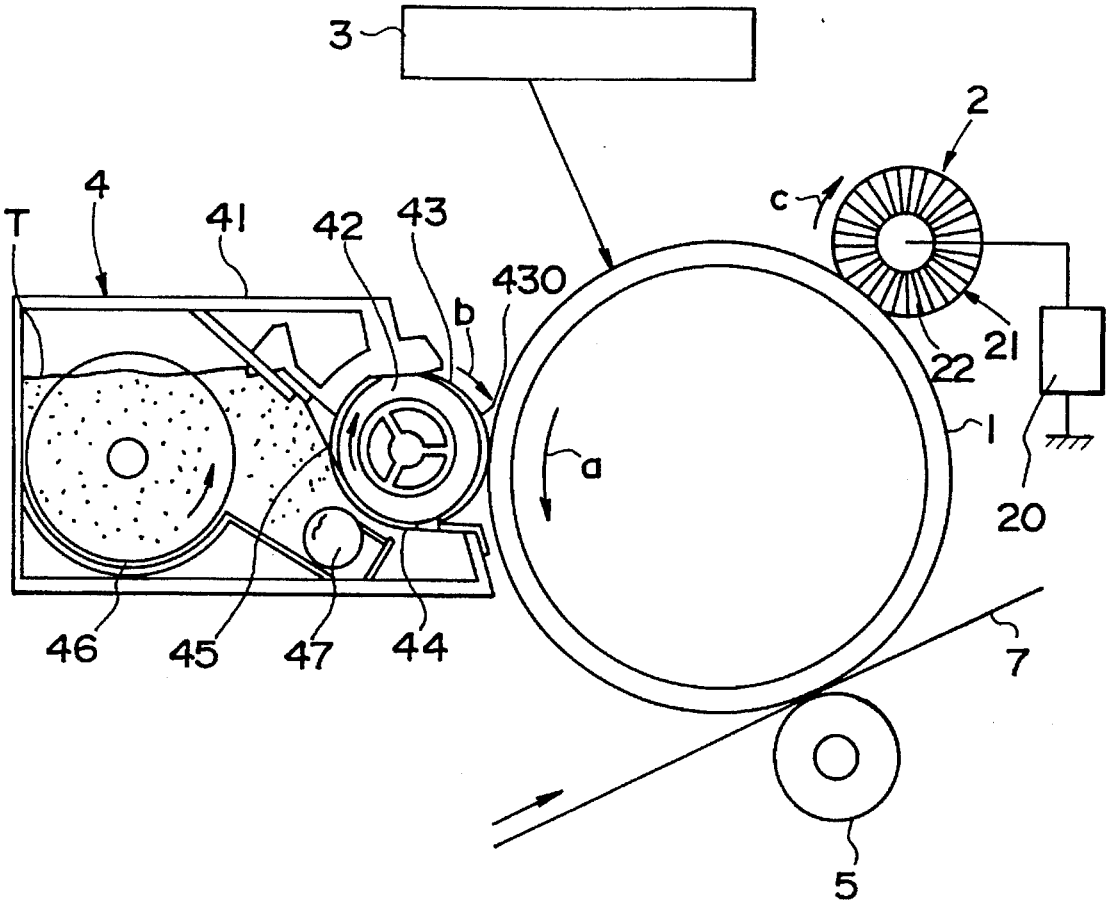
FIG. 1 briefly shows the construction of the essential portion of a printer of a first embodiment of the invention.

The preferred embodiments of the present invention are described hereinafter with reference to the accompanying drawings. FIG. 1 briefly shows the construction of the essential portion of a printer comprising a first embodiment of the invention.

The printer in the drawing is provided with a photosensitive drum 1 in a central area. Drum 1 is driven in rotation in the arrow a direction (counterclockwise direction) via a drive source not shown in the drawing. Arranged sequentially around the periphery of said drum 1 are brush charger 2, developing device 4, and roller transfer device 5. Disposed above photosensitive drum 1 is an image exposure device 3.

The rotating brush 21 of brush charger 2 makes contact with the surface of photosensitive, and uniformly charges said surface of photosensitive drum 1 to a potential of −600 V~−800 V when a DC voltage is supplied from power source 20.

Rotating brush 21 is a brush member forms as shown in FIG. 6A, i.e., a pile comprising a plurality of conductive brush fibers (thickness: 6~10 deniers/F) woven in a V-type weave in a fabric base to form a brush member having a plurality of implants, said brush member being wound in a spiral configuration on a rotatably driven conductive metal core rod with no space therebetween as shown in FIG. 9A, and adhered thereto by conductive adhesive to produce rotating brush 21.

Rotating brush 21 makes contact with the surface of photosensitive drum 1 such that brush layer 22 has a uniform overlap as shown in FIG. 2A, wherein the contact nip N and brush thickness t are set so as to satisfy the condition $20 \leqq (N)^2/t \leqq 35$. In the present embodiment, the brush thickness is alteratively called the pile thickness.

The rotational direction c of rotating brush 21 is the opposite direction relative to the rotation direction a of photosensitive drum 1. When viewing the movement direction of the contact region between the rotating brush 21 and photosensitive drum 1, the brush 21 rotation direction c can be seen as the so-called follow direction with respect to the rotation direction of photosensitive drum 1.

Image exposure device 3 uses well-known semiconductor laser to reduce the potential of the image region of the surface of photosensitive drum 1 charged to, for example, −800 V to about −50 V via irradiation by a laser beam.

Developing device 4 is a monocomponent developing device using a reversal development method. A drive roller 42 which is rotatably driven in the arrow b direction in the drawing is supported in casing 41 and is sheathed by a flexible developing sleeve 43 which has an interior diameter slightly larger than the exterior diameter of said drive roller 42. Both ends of developing sleeve 43 make pressure contact with drive roller 42 via a belt member 44 from the interior side of casing 41 so as to form a slack portion 430 on the opposite side thereof, said slack portion 430 making contact with the surface of photosensitive drum 1. A metal regulating blade 45 abuts developing sleeve 43 within casing 41.

Toner T, i.e, a monocomponent developer accommodated in casing 41, is supplied to toner transporting roller 47 while being mixed by mixing member 46 rotatably driven in a counterclockwise direction in the drawing, said roller 47 transporting toner T to developing sleeve 43 as it is rotated in a clockwise direction in the drawing. Developing sleeve 43 is driven in rotation in the same direction as the drive roller in conjunction with the rotation of drive roller 42 via a friction force, and regulating blade 45 triboelectrically charges toner T and adheres a uniform amount of said toner T on the surface of developing sleeve 43. Developing sleeve 43 sequentially supplies toner T to the contact region with photosensitive drum 1 via the aforesaid rotation.

A developing bias voltage of −250 V is supplied to developing sleeve 43 from a power source not shown in the drawings, such that toner T is adhered to the electrostatic latent image formed on the surface of photosensitive drum 1 via said bias voltage.

Photosensitive drum 1 and the toner T used in the developing device 4 are described in detail below.

*Photosensitive drum 1

Photosensitive drum 1 is a negative-charging function-separated organic photosensitive member having excellent sensitivity to long wavelength light such as semiconductor laser light (wavelength: 780 nm), LED light (wavelength: 680 nm) and the like, and is manufactured in the manner described below.

One-part-by-weight τ-type nonmetallic phthalocyanine, 2 parts-by-weight polyvinyl butyral resin, and 100 parts-by-weight tetrahydrofuran were mixed for 24 hr using a ball mill to obtain a photosensitive fluid application. At this time, the viscosity of the photosensitive fluid application was 15 cp at 20°. The polyvinyl butyral resin comprised 3 molar % or less acetylation, 70 molar % butylation, and polymerization degree of 1,000.

This fluid application is applied by a dipping method on the surface of a cylindrical substrate measuring 240 mm long and 0.8 mm thick, so as to form, after drying, a charge-generating layer having a layer thickness of 0.4 μm. This cylindrical substrate was an aluminum alloy containing 0.7 percent-by-weight of magnesium and 0.4 percent-by-weight silicon, and the drying conditions were about 30 min in a recirculating air environment at 20° C.

Over the aforesaid charge-generating layer was applied a fluid application comprising 8 parts-by-weight hydrazone compound shown in the structural formula below, 0.1 parts-by-weight orange color (Sumiplast Orange 12; Sumitomo Chemicals, Ltd.) and 10 parts-by-weight polycarbonate resin (Panlite L-1250; Teijin Chemicals, Ltd.) dissolved in a solvent comprising 180 parts-by-weight tetrahydrofuran, said fluid application was dried to form a charge-transporting layer having a layer thickness of 28 μm.

The viscosity of the fluid application at this time was 240 cp at 20° C., and drying conditions were about 30 min in an environment of recirculating air at 100° C.

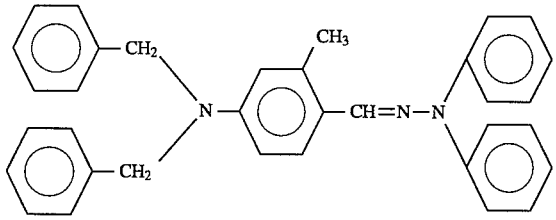

A function-separated type negative-charging organic photosensitive drum 1 having sequential laminations of a charge-generating layer and charge-transporting layer superimposed on a conductive substrate was thus prepared in the previously described manner.

The τ-type nonmetallic phthalocyanine used in the manufacture of the charge-generating layer has an X-ray diffraction pattern exhibiting strong peaks at Bragg angles (2θ±0.2 degrees) of 7.7, 9.2, 16.8, 17.4, 20.4, and 20.9 degrees when a Cu/Kα/Ni X-ray having a wavelength of 1.541 Å is used. In the infrared absorption spectrum, there are four absorption bands between 700~760 $cm^{-1}$ which are most intense at 751±2 $cm^{-1}$, and two absorption bands between 1320~1340 $cm^{-1}$ which have nearly equal intensity of 3288±3 $cm^{-1}$.

The toner used in developing device 4 is described below.

The toner is a negative-charging non-transparent magnetic black toner comprising a mixture of 100 parts-by-weight (hereinafter "pbw") type-A bisphenol polyester resin, 5 pbw carbon black (MA#8; Mitsubishi Chemicals, Ltd.), 3 pbw charge control agent (Bontoron S-34; Orient Kagaku Kogyo K.K.), and 2.5 pbw wax (biscol TS-2050; Sanyo Kasei Kogyo K.K.), said mixture being kneaded, pulverized, and classified by well-known methods to produce toner particles having an 80% weight distribution within a range of 7~13 μm and a mean particle size of 10 μm. To these toner particles was added 0.75 percent-by-weight hydrophobic silica (Tullanox 500; Cabosil Co., Ltd.) as a fluidizing agent, and the materials were mixed using a homogenizer.

According to the printer described above, the surface of rotatably driven photosensitive drum 1 is charged, for example, to a uniform surface potential of −800 V by brush charger 2, and the charged region of said drum surface is subjected to optical image exposure via image exposure device 3, so as to form an electrostatic latent image thereon. The surface potential of the optically exposed region is reduced to about −50 V. The thus formed electrostatic latent image is developed as a toner image by developing device 4 when a developing bias voltage of −250 V is supplied thereto. During the aforesaid development, toner T on the surface of developing sleeve 43 is adhered to the latent image by the potential difference ΔV=200 V.

The thus formed toner image is transferred cia roller-type transfer device 5 onto a sheet 7 transported from a transfer sheet supplying means not shown in the drawing, after which said sheet 7 is separated from photosensitive drum 1 and fed to a fixing device (not illustrated) which fixes the toner image on said transfer sheet 7 which is then ejected.

All the toner on the surface of photosensitive drum 1 is not completely transferred to transfer sheet 7, and typically 10~20% of said toner remains on drum 1 as residual toner. This residual toner is charged by charger 2, subjected to an exposure process by exposure device 3 as needed, and again arrives at developing device 4, and the residual toner in the non-image region is collected by developing sleeve 43.

In this case, when residual toner remaining on the surface of photosensitive drum 1 has been charged and exposed, a part of the toner is not charged and not exposed. This problem leads to the disadvantage of exposure memory which results when rotating brush 21 disrupts the residual toner after image transfer so as to disperse said toner, and the surface of photosensitive drum 1 is uniformly charged and subsequently subjected to image exposure regardless of the presence of residual toner.

In the aforesaid printer, rotating brush 21 of brush charger 2 is rotatably driven in the following direction with respect to photosensitive drum 1, and the contact nip N with photosensitive drum 1, and brush thickness t are set so as to satisfy the condition $20 \leqq (N)^2/t \leqq 35$. The transfer efficiency at this time is naturally relatively high, and even when the transfer efficiency is reduced, for example, to about 60% in image formation under environmental conditions of high temperature and high humidity, there is scant concern of filming of the photosensitive drum 1 by the residual toner remaining thereon after image transfer, because the residual toner remaining after image transfer is adequately disrupted and dispersed so as to suppress exposure memory and like disadvantages and form excellent images.

The mechanism for removing and collecting residual toner via developing device 4 involves achieving a uniform surface potential of photosensitive drum 1 of about −800 V including the region having residual toner, and applying a developing bias voltage of −250 V to the developing sleeve 43. Accordingly, the residual toner T in the non-image region of the surface of photosensitive drum 1 migrates toward developing sleeve 43 by the potential difference of about 550 V, while at the same time the residual toner of the non-image region is removed and collected by developing sleeve 43.

The transfer efficiency is determined by a normal method, wherein the photosensitive drum 1 is removed during image formation which repeats the charging-exposure-developing-transfer sequence, and the amount of toner adhered per centimeter to the surface of photosensitive drum 1 after development is measured, and the amount of toner adhered per centimeter to the surface of photosensitive drum 1 after image transfer is measured to determined transfer efficiency via the following equation.

[1-(post transfer amount of adhered toner)/(post development amount of adhered toner)]×100 (%)

In the printer shown in FIG. 1, the conditions of the rotating brush of charger 2 were variously changed and printing was performed with said rotating brush in normal and reverse rotation to experimentally determine the aforesaid condition $20 \leqq (N)^2/t \leqq 35$.

Rotating brush=rotating brush used in charger 2 (same construction as rotating brush 21)

D=diameter of rotating brush

X=amount of overlap of rotating brush (relative to drum 1)

$\alpha=(N)^2/t$ (where N is the contact nip width between rotating brush and photosensitive drum)

$\theta$=(exterior circumferential speed of rotating brush/circumferential speed of drum 1)

In all experiments the diameter of the photosensitive drum was 30 mm.

Image evaluation was accomplished by consecutively printing black monochrome images on two segments of photosensitive drum 1, and the difference in density is measured between black image IB1 formed on the first segment of the drum 1 and black image IB2 formed on the following second segment of drum 1. This measured density difference was ranked in five levels as described below. The density of image IB1 met the condition of a density of 1.35 or higher.

| Density Diff. | Rank |
|---|---|
| below 0.05 | 5 |
| 0.05~0.075 | 4.5 |
| 0.075~0.1 | 4 |
| 0.1~0.125 | 3.5 |
| 0.125~0.15 | 3 |
| 0.15~0.175 | 2.5 |
| 0.175~0.2 | 2 |
| 0.2~0.225 | 1.5 |
| 0.225~0.25 | 1 |
| 0.25 or higher | 1 |

Experimental example 1-1

Rotating brush conditions:

Brush fiber density: 100,000 fibers/square inch$^2$

Brush material: conductive rayon (volume resistivity $10^6$ Ωcm)

D=16 mm

X=1.5 mm t=3.3 mm

N=8.2 mm $\alpha$=20.4

$\theta$=2.0

DC voltage applied to rotating brush: −1.3 kV

Charged potential of drum: uniform −800 V

Transfer efficiency: set at 85%

Image evaluation: rank 4

Experimental example 1-2

The conditions were identical to example 1-1 with the exception that the rotating brush condition $\theta$=−2.0 (the negative mark indicates rotation in the counter direction).

In experiment 1-2, the filming phenomenon was observed. Similar filming was noted also when $\theta$=−3.0.

According to examples 1-1 and 1-2, filming occurred even with a transfer efficiency of 85% if $\theta$ is negative, in other words, rotational direction of the rotating brush of the charger is a counter direction relative to the direction of movement of the photosensitive drum.

Experimental example 2-1

Rotating brush conditions:

Brush fiber density: 100,000 fibers/square inch$^2$

Brush material: Same as example 1-1

D=16 mm

X=2.7 mm t=4.0 mm

N=11.0 mm $\alpha$=30

$\theta$=3.0

DC voltage applied to rotating brush: −1.5 kV

Charged potential of drum: uniform −800 V

Transfer efficiency: set at 60%

Image evaluation: rank 5 regardless of brush fiber material, applied voltage, or charging potential Experimental example 2-2

The conditions were identical to those of example 2-1 with the exception that $\alpha$=10 (N=6.3 mm, t=3.9 mm).

Evaluation result: rank about 2.5 in all cases

In examples 2-1 and 2-2, even if transfer efficiency was 60%, post transfer residual toner dispersion was adequately effective and images were without problems when $\theta$ is positive, in other words, the rotating brush rotation direction was the following direction relative to the direction of movement of the drum, and $\alpha$ value was high. Conversely, when the $\alpha$ value was low, poor images were obtained.

Experimental example 3

Rotating brush conditions:

Brush fiber density: 100,000 fibers/square inch$^2$

Brush material: conductive rayon (volume resistivity $10^6$ Ωcm)

D=18 mm

X, t, N, and $\alpha$ were set in the following combinations.

| | X (mm) | N (mm) | t (mm) | $\alpha$ (mm) |
|---|---|---|---|---|
| (1) | 0.6 | 5 | 5 | 5 |
| (2) | 0.8 | 6 | 3.6 | 10 |
| (3) | 1.4 | 8 | 4.3 | 15 |
| (4) | 2.3 | 10 | 5 | 20 |

-continued

| | X (mm) | N (mm) | t (mm) | α (mm) |
|---|---|---|---|---|
| (5) | 2.3 | 10 | 4 | 25 |
| (6) | 3.3 | 12 | 4.8 | 30 |
| (7) | 3.3 | 12 | 4.2 | 35 |

θ=–0, 1, 2, 3, –2 for each α value. (θ=0 is the state wherein the rotating brush is stationary.)

DC voltage applied to rotating brush: –1.5 kV

Charged potential of drum: uniform –800 V

Transfer efficiency: set at 60±5%

Figure 3:
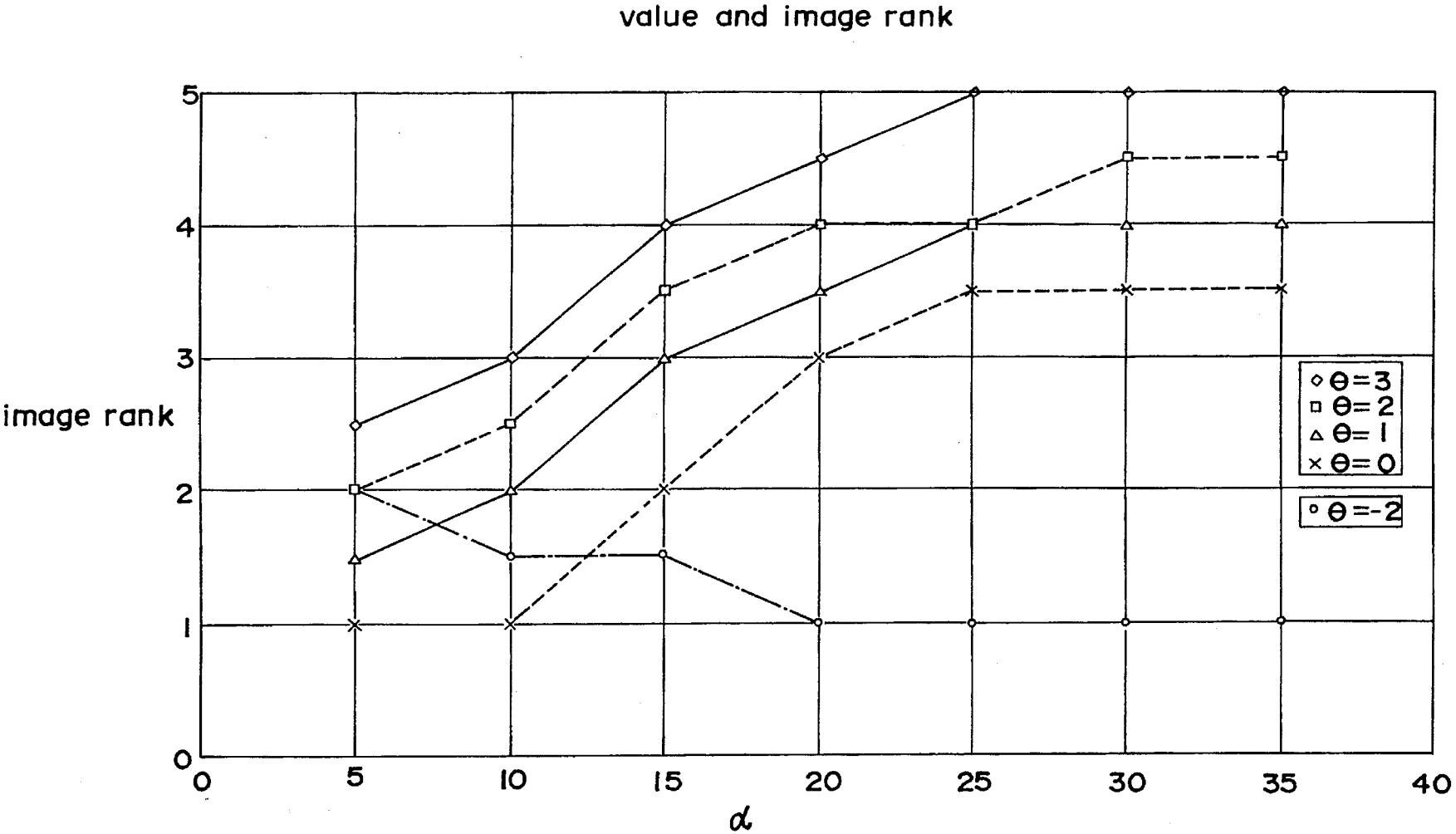
FIG. 3 is a graph showing the results of experiments investigating the relationship between $\alpha(\doteq N^2/t$, where N is the contact nip width between the rotating brush and the photosensitive drum, and t is the layer thickness of the rotating brush) and θ ((exterior circumferential speed of the rotating brush)/(circumferential speed of the photosensitive drum)) in the state of the formed image (image evaluation rank)

Image evaluations: shown in FIG. 3

In example 3, in case that θ was negative, θ is studied at a value of –2. When θ<0, filming occurred regardless of the value, and image evaluations rankings were 1~2. An image ranking is always less than 3 when θ was negative value, in other words, transfer efficiency was 60% and the rotational direction of the rotating brush was the counter direction relative to the movement of the drum.

When θ was negative in the previously described experiments, filming occurred, and not only did generalized exposure memory occur, but also vertical stripe image noise, which presents a severe problem in practical image formation. In this case, since noise was produced in both images IB1 and IB2, it is extremely difficult to evaluate the images by the aforesaid rankings. Thus, (1.35-(the density at which IB2 filming began)) was designated the image density difference for evaluation purposes. The numerical value 1.35 is deemed the practical lower limit of black color image density which poses no problem.

The evaluation rankings were invariable 1~2.

It can be understood from the experimental results that excellent images are formed, exposure memory is suppressed, and filming is avoided when the rotation direction of the rotating brush is the follow direction relative to the direction of movement of the latent image-bearing member and the condition $20 \leqq (N)^2/t$ is satisfied. When $(N)^2/t$ is greater than 35, however, the drive torque of the rotating brush becomes excessive and impractical for use. Accordingly the condition $20 \leqq (N)^2/t \leqq 35$ is suitable.

Figure 4:
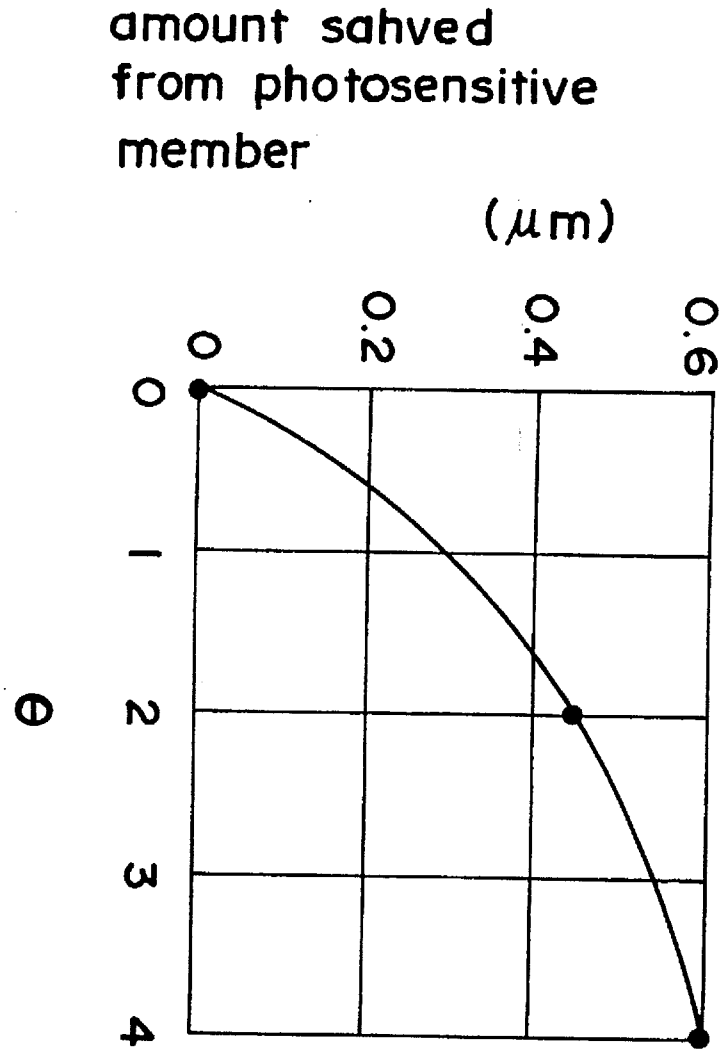
FIG. 4 is a graph showing the relationship between θ and the amount shaved from the photosensitive member surface.

The aforesaid experimental results, and specifically the results shown in FIG. 3, indicate that suppression of poor exposure is more effective the larger the value of θ is. When the value of θ becomes too large, however, too much is shaved from the surface of the photosensitive drum by the rotating brush. The relationship between the amount shaved and the value of θ when 1,000 sheets were printed, is shown the examples of FIG. 4. FIG. 4 shows a condition that the amount of an overlap between the rotating brush and drum 1 is 1.5 mm and α value is 10~20. In the range of α=20~35, the amount shaved increases to some extent, because the amount of the overlap increases. When the amount shaved is equal to or grater than 0.8 μm/1,000 prints, the service life of the photosensitive member is shortened, thereby shortening the drum replacement cycle, and inconveniencing the user. Although increasing the thickness of the photosensitive layer may be considered, such would increase manufacturing costs. Accordingly, a θ range of $3 \leqq \theta \leqq 10$ is considered appropriate for effectively suppressing shaving of the photosensitive surface and dispersion of the residual developer.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an image bearing member;

a charging device including a rotatable brush for charging the image bearing member to form a latent image on the image bearing member by image exposure; and developing device for developing the latent image, and collecting residual toner remaining on the image bearing member after transferring the developed image, wherein said rotatable brush rotates in such a direction that a contacting portion of the brush with the image bearing member moves in the same direction as a moving direction of a surface of the image bearing member, and is provided to satisfy the following condition:

$$20 \leqq (N)^2/t \leqq 35,$$

wherein N is a contact nip width between the charging brush and the image bearing member and t is a thickness of the charging brush.

2. The image forming apparatus as claimed in claim 1 further comprising a power source which applies a voltage including AC voltage.

3. The image forming apparatus as claimed in claim 1, wherein said developing device develops the latent image with a mono-component developer.

4. The image forming apparatus as claimed in claim 3, wherein said developing device develops the latent image by reversal development.

* * * * *